US005867852A

United States Patent [19]

Knight

[11] Patent Number: 5,867,852

[45] Date of Patent: Feb. 9, 1999

[54] BACK SUPPORT WITH ADJUSTABLE STRAPS

[76] Inventor: Gerald Malcolm Knight, Betty Mundy's Cottage, Lower Preshaw, Upham Southampton, United Kingdom, SO3 1HP

[21] Appl. No.: 930,024

[22] PCT Filed: Mar. 27, 1995

[86] PCT No.: PCT/GB95/00699

§ 371 Date: Sep. 26, 1997

§ 102(e) Date: Sep. 26, 1997

[87] PCT Pub. No.: WO96/29916

PCT Pub. Date: Oct. 3, 1996

[51] Int. Cl.[6] ..... A47C 21/06; A47C 21/00

[52] U.S. Cl. ..... 5/659; 24/270; 24/279

[58] Field of Search ..... 5/659, 660, 658; 24/270, 279

[56] References Cited

U.S. PATENT DOCUMENTS 1,954,382 4/1934 González ..... 5/195

3,346,891 10/1967 Cundiff ..... 5/220

FOREIGN PATENT DOCUMENTS 0572895 12/1993 European Pat. Off. ..... 5/659

2836684 11/1979 Germany .

*Primary Examiner*—Alexander Grosz

*Attorney, Agent, or Firm*—Ware, Fressola, Van Der Sluys & Adolphson LLP

[57] ABSTRACT

The invention provides a back support for supporting a mattress on a bed having a bed base. The back support comprising a generally rectangular frame, a plurality of strap fittings and a corresponding plurality of individually adjustable straps. The generally rectangular frame have side members. The plurality of strap fittings are arrangable along the side members of said frame. The corresponding plurality of individually adjustable straps are attachable to said strap fittings to extend laterally between said side members (i.e. extending laterally of the mattress in use) for supporting the mattress. The back support is adapted to be placed onto the bed base to lie between the bed base and the mattress.

20 Claims, 4 Drawing Sheets

BACK SUPPORT WITH ADJUSTABLE STRAPS

TECHNICAL FIELD

The present invention relates to a support for the back of a person lying in bed.

BACKGROUND OF THE INVENTION

Many people suffer from bad backs. The problem can be alleviated by sleeping on a bed having a suitably constructed mattress. I have tried many mattresses over the years and not found one which gives me lasting relief from back pain.

SUMMARY OF THE INVENTION

My invention is a support to be placed between a bed base and its mattress for supporting the mattress and hence the back of the user in selected position(s).

According to my invention, I provide a frame for supporting a mattress, the frame having a plurality of laterally extending straps (i.e. extending laterally of the mattress in use), the straps being individually adjustable.

In use, the mattress is laid over the frame and the straps are adjusted to support it and the user lying on it at the position(s) or region(s) of his/her back requiring support against painful bending due to sagging of the mattress; the general objective being for the user's spine to be supported in a horizontal plane when lying on his/her side.

Whilst it is envisaged that the frame may be incorporated into the frame or base of a bed, I prefer to lay the frame onto an existing bed base and place the mattress on top of the base and frame. The frame may be as long as the mattress, but I find this unnecessary. Typically a frame of about two thirds the length of the mattress is adequate, because it is unnecessary to have the frames adjustability beneath the user's legs. Further a short frame allowing the legs to be sightly lower than the torso can be benficial in causing he legs to pull on the pelvis and tension the spine. Accordingly, the frame is preferably adapted for support of side members of the frame above the bed base.

Preferably the straps are of resilient, elastomeric material, so that they have some "give" to the user's weight.

The straps may be adjusted as to their tension. They may alternatively be adjustable as to their height of attachment to the frame. Preferably they are adjustable as to both their tension and height of attachment.

In the preferred embodiment, the straps are attached to the frame via fittings, each having:

an over-centre buckle, a strap attachment ladder and a height adjuster for the strap attachment ladder.

Conveniently, the height adjuster acts on a tension member in the buckle connected to the strap attachment ladder.

BRIEF DESCRIPTION OF THE DRAWINGS

To help understanding of the invention, a specific embodiment thereof will now be described by way of example and with reference to the accompanying drawings, in which.

BEST MODE FOR CARRYING OUT THE INVENTION

Figure 1:
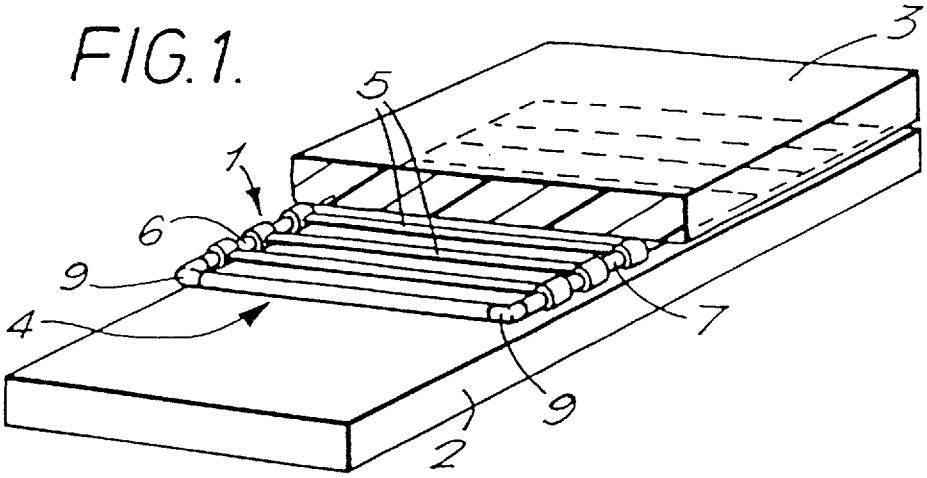
FIG. 1 is a perspective view of a back support of the invention installed on a bed with a mattress shown partially broken away.
Figure 2:
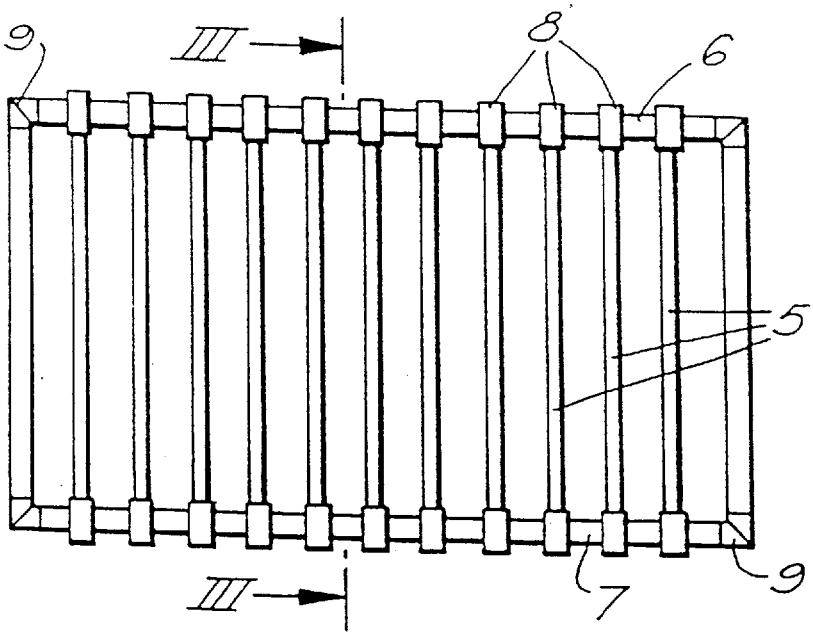
FIG. 2 is a plan view of the back support of FIG. 1.
Figure 3:
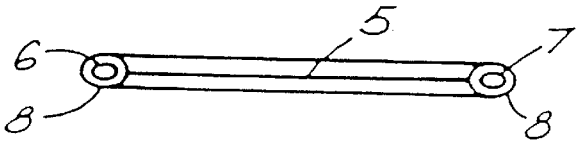
FIG. 3 is a cross-sectional end view of the support on the line III—III.

Referring first to FIGS. 1, 2 and 3, the back support 1 is installed on a bed base 2 beneath a mattress 3. The support has a frame of steel tube 4 and a number of straps 5 extending between the side members 6,7 of the frame. The straps extend laterally, that is crosswise, of bed and mattress. They are attached to the frame by fittings 8. Plug and socket members 9 are provided at the corners of the frame 4 to connect the individual members of the frame.

Figure 4:
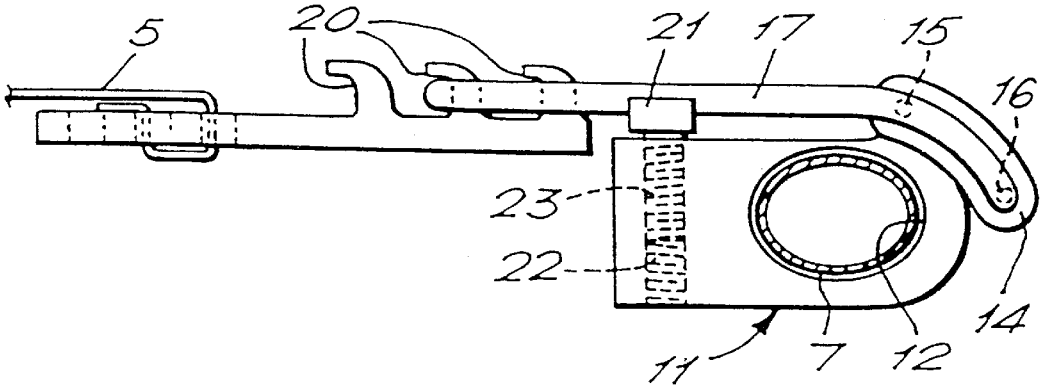
FIG. 4 is a similar end view in more detail and on a larger scale of a strap end fitting.
Figure 5:
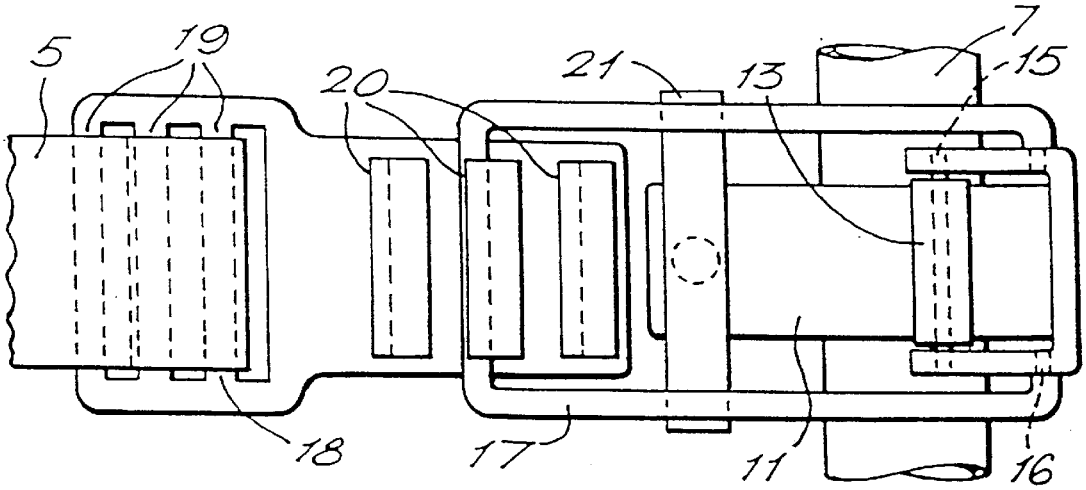
FIG. 5 is a plan view of the strap end fitting.

Referring now to FIGS. 4 and 5, the fittings 8 comprise a moulded plastics material body 11, having an opening 12 which is a sliding fit on the steel tube of the side members 6,7. The tube is of oval cross-section, which has the twin advantages of preventing the fittings 8 from rotating around the tube and of ensuring the frame does not have sharp corners which could be painful when the bed is being made for instance. Pivotally attached to the body 11 at a pivot point 13 is a moulded plastics material, buckle lever 14, having a steel pivot pin 15 engaged in the pivot point 13. Towards its distal end, the lever has a pivot point 16 for a buckle loop 17. The loop extends inwards of the frame to a strap attachment ladder 18. This has three rungs 19 around which one of straps 5 is threaded, at a position of which is adjustable according to the tension required in the strap. The ladder has three alternative hook points 20, to which the loop 17 can be hooked.

The support is set up as follows. Each strap is threaded to the ladders 18 at its opposite ends. The hook point 20 suitable for the required tension in the strap is selected and the loop 17 engaged in it. The buckle lever 14, which was lifted up is pressed down about the pivot point 13 to tension the strap. The loop 17 passes over centre with respect to the pivot point 13, whereby the lever is held by the tension in the strap against the body 11.

At the inner edge of the body of each fitting, its loop 17 passes over a knuckle 21, whereby the ladder 18 and its strap can flex up and down about the chosen hook point 20. The knuckle is adjustable up and down either via a threaded bore 22 in the body and a threaded stem 23 by which it engages the body or via a peg (not shown) engaging in the body and the stem if the latter and the bore in the body are plain. The knuckles can be adjusted up for those of the straps which are required to give more local support to the user and down for those giving less support. They also allow the tension in the straps to be kept more even than would be the case if they were all level.

The invention is not intended to be restricted to the details of the above described embodiment; for instance buckles need not be provided at both ends of the straps. The loops 17 can be hooked directly onto the pivot points 13 at one end of each strap. Further in place of the buckles, means may be provided in fittings for tensioning their straps via screws acting in the general direction of the straps.

Figure 6:
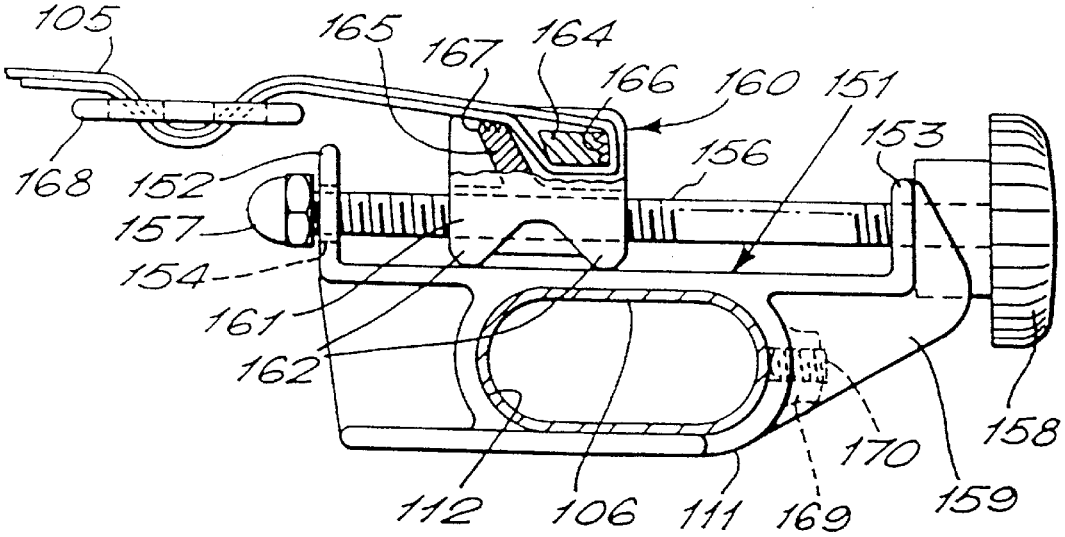
FIG. 6 is a view similar to FIG. 4 of another strap end fitting.
Figure 7:
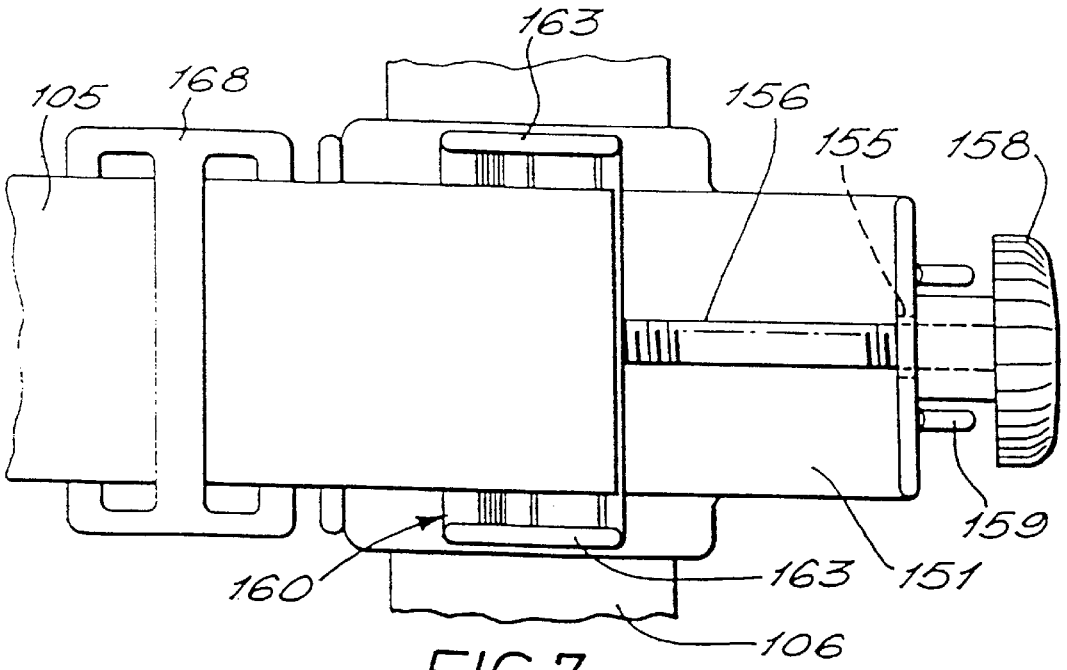
FIG. 7 is a plan view of the fitting of FIG. 6.

This latter variant is illustrated in FIGS. 6 & 7. The fitting thereshown has an injection moulded body 111, having an opening 112 similar to the opening 12. Above the opening 112, the body has a flat 151, with upstanding flanges 152,153 at its inner and outer edges. The flanges have central apertures 154,155 through which freely extends a threaded rod 156. The inner end of this has a capnut 157. The outer end has an adjustment knob 158. To either side of a boss of the knob, webs 159, which reinforce the flange 153, extend down to the bottom of the fitting. An adjustable strap holder 160 is carried on the flat 151. It has a threaded bore 161, in which the rod 156 is threadedly engaged. The holder has feet 162 which bear against the flat 151. The holder extends out beyond the flat and has end plates 163. Between these extend a bar 164 and an upstand 165. The outer edge of the bar and the top of the upstand are provided with ribs 166,167 for gripping a strap 105 threaded around the bar and back under itself at the upstand. To guard against slipping of the end of the strap, it and the main portion of it can be threaded through an optional double slotted plate 168. For securing the position of the fitting on its side member, an internally threaded boss 169 with a grub screw 170 is provided between the two webs 159. It will be understood that turning of the knob 158 moves the strap holder and adjusts the tension of the strap. This can be done by the user whilst lying on the bed. The other end of the strap can be held by a similar fitting, or a modified one in which the strap holder is moulded integrally with the body 111.

Figure 8:
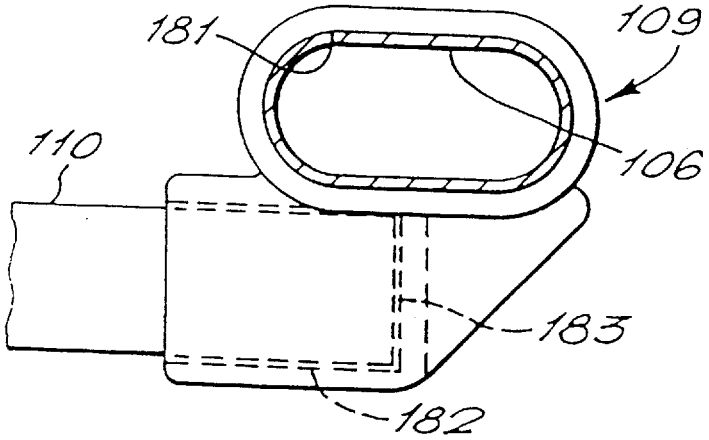
FIG. 8 is a view similar to FIG. 6 of a frame corner fitting.
Figure 9:
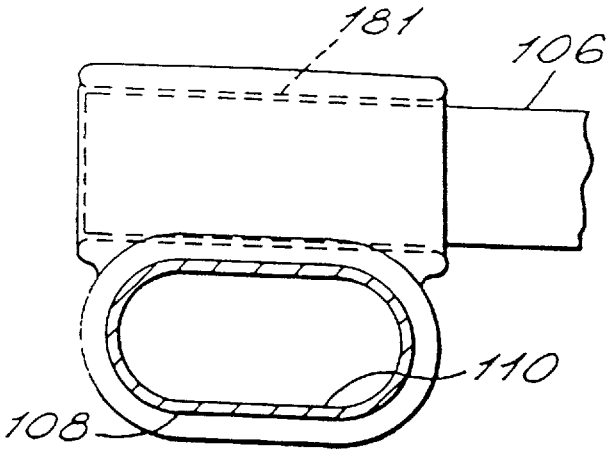
FIG. 9 is a side view of the corner fitting.

The corner fitting 109, shown in FIGS. 8 & 9, has an opening 181, similar to the opening 112, for its frame side member 106. Beneath the opening 181 and set at right angles to it is a second opening 182 for a frame end member 110. This opening is provided with a blind end 183 against which the end member abuts to resist the tension in the straps in use. It will be noted that the end member 110 is arranged beneath the side member 106, whereby the latter is lifted above the bed base in use. Non-illustrated, height-varying feet may be fitted to the corner fittings to adjust the height of the frame above the bed base. It is envisaged that the head end of the frame may be at a height different from the opposite end.

In a non-illustrated embodiment, the frame is provided with means for adjusting the separation of its long sides, whereby the straps can be tensioned together. This can effected for instance by providing a threaded boss in the blind end 183 of the corner fitting and arranging a screw engaged in the boss to bear on the end of the end member of the frame. Screwing in of the screw moves the fitting away from the opposite side fitting, tensioning the straps as a whole. To achieve individually different tensions in them, the straps can be set to have different free lengths. This enables the means for tensioning of the individual straps to be dispensed with. Nevertheless some of the straps may require individual adjustment, for which the above described fittings can be used. Height adjustment as described above may be provided, but if no buckle nor screw device is provided for individual tensioning of the straps, height adjustment may be provided by arranging for the straps to be attached to frame fittings at alternative heights.

What is claimed is:

1. A back support (1) for supporting a mattress (3) on a bed base (2), the back support (1) comprising:

a generally rectangular frame (4) having side members (6, 7);

a plurality of individually adjustable straps (5) to extend laterally between said side members (6, 7) (i.e., extending laterally of the mattress (3) in use) for supporting the mattress (3); and a plurality of strap fittings (8) arranged along the side members (6, 7) of the generally rectangular frame (4), each strap fitting (8) having means for adjusting the tension of an associated strap (5);

said support (1) dimensioned so as to be placed onto the bed base (2) and to lie between the bed base (2) and the mattress (3).

2. A back support (1) according to claim 1, wherein the frame (4) is the length of a conventional bed.

3. A back support (1) according to claim 1, wherein the frame (4) is approximately two thirds the length of a conventional bed.

4. A back support (1) according to claim 1, wherein the individually adjustable straps (5) are made of resilient, elastomeric material.

5. A back support (1) according to claim 1, wherein the strap fittings (8) are adapted for adjustment of the straps (5) as to their tension between the frame side members (6,7).

6. A back support (1) according to claim 1, wherein the strap fittings (8) are adapted for adjustment of the straps (5) as to their height of attachment to the frame side members (6,7).

7. A back support (1) according to claim 1, wherein at least one strap fitting (8) for each strap (5) has screw means for tensioning its strap (5).

8. A back support (1) according to claim 7, wherein the screw means comprises a screw (156) captive on a base of the fitting (8) and a strap holder (160) having the screw (156) engaged in it, the strap (105) being engaged with the strap holder (160), whereby tightening of the screw (156) moves the strap holder (160) to tension its strap (105).

9. A back support (1) according to claim 1, wherein the strap fittings (8) have a sliding fit on the side members (6,7) of the frame (4).

10. A back support (1) according to claim 1, wherein the side members (6,7) of the frame (4) are of oval cross-section and the fittings (8) each having a correspondingly shaped opening, the arrangement restraining the fittings (8) from rotating about the side members (6,7) under tension of the straps (5).

11. A back support (1) according to claim 1, wherein the side members (6,7) of the frame (4) are provided at fixed separations.

12. A back support (1) according to claim 1, wherein the frame (4) is provided with means for adjusting the separation of its side members (6,7).

13. A back support (1) according to claim 12, including corner fittings (109) between the side members (6,7) of the frame (4) and end members (110) of the frame, the corner fittings (109) receiving the end members (110) and being provided with screws bearing on the ends of the end members (110), whereby screwing in of the screw moves the fitting (109) away from the opposite side fitting (109), tensioning the straps (5) as a whole.

14. A back support (1) according to claim 1, wherein the frame (4) is adapted for support of side members (6,7) above the bed base (2).

15. A back support (1) according to claim 14, including means for holding ends of the side members (6,7) above the bed base (2).

16. A back support (1) according to claim 15, including corner fittings (109) between the side members (6,7) of the frame (4) and end members (110) of the frame, the corner fittings (109) being adapted to receive the end members (110) beneath the side members (6,7), whereby the end members (110) bear in use on the bed base (2) and hold the side members (6,7) above the bed base (2).

17. A frame according to claim 1, wherein at least one strap fitting for each strap has an over-center buckle for tensioning its strap.

18. A frame according to claim 1, wherein each strap fitting has a strap attachment ladder via which its strap is connectable to the fitting.

19. A frame according to claim 18, wherein each strap fitting has a height adjuster for the strap attachment ladder.

20. A frame according to claim 1, wherein:

at least one strap fitting for each strap has an over-center buckle for tensioning its strap via a tension member;

each strap fitting has a strap attachment ladder via which its strap is connectable to the fitting; and each strap fitting has a height adjuster for acting on the tension member in the buckle connected to the strap attachment ladder.

* * * * *

UNITED STATES PATENT AND TRADEMARK OFFICE

CERTIFICATE OF CORRECTION

PATENT NO. : 5,867,852

DATED : February 9, 1999

INVENTOR(S) : Knight

It is certified that error appears in the above-identified patent and that said Letters Patent is hereby corrected as shown below:

Column 1, line 38, "benficial" should be --beneficial--.

Column 1, line 38, "he" should be --the--

Signed and Sealed this

Fifteenth Day of June, 1999

*Attest:*

*Attesting Officer*

Q. TODD DICKINSON

*Acting Commissioner of Patents and Trademarks*